United States Patent [19]

Ferguson et al.

[11] Patent Number: 4,510,918

[45] Date of Patent: Apr. 16, 1985

[54] WOODBURNING HEATING APPARATUS

[75] Inventors: Robert W. Ferguson, South Royalton; Derik K. Andors; William W. Crossman, Jr., both of Randolph, all of Vt.

[73] Assignee: Vermont Castings, Inc., Randolph, Vt.

[21] Appl. No.: 555,511

[22] Filed: Nov. 28, 1983

[51] Int. Cl.[3] ..... F24C 1/14

[52] U.S. Cl. ..... 126/79; 126/58; 126/77

[58] Field of Search ..... 126/79, 77, 121, 58, 126/61

[56] References Cited

U.S. PATENT DOCUMENTS

| | | | |
|---|---|---|---|
| 4,249,509 | 2/1981 | Syme | 126/77 |
| 4,330,503 | 5/1982 | Allaire et al. . | |
| 4,345,528 | 8/1982 | Allaire et al. . | |
| 4,363,785 | 12/1982 | Willson | 126/61 X |
| 4,380,228 | 4/1983 | Crowley | 126/76 |
| 4,425,305 | 1/1984 | Retallick | 126/77 X |

OTHER PUBLICATIONS

"The Shelburne Catalytic", Brochure, The Vermont Stove Company, Nov. 1983.

"Hart Insert", Brochure, Hart Fireplace Furnishings Co., Nov. 1983.

*Primary Examiner*—Larry Jones

*Attorney, Agent, or Firm*—Kenway & Jenney

[57] ABSTRACT

Woodburning heating apparatus including a catalytic igniter for increasing heating efficiency and reducing polluting emissions. The apparatus includes a secondary combustion chamber in gaseous communication with a primary combusiton chamber. The secondary combustion chamber is lined with a refractory material and includes a perforate catalytic igniter through which combustion gases from the primary combustion chamber flow. The secondary combustion chamber further includes refractory baffles arranged to enhance mixing of the combustion gases and located to re-radiate heat onto the catalytic igniter. Preheated secondary combustion air enters the secondary combustion chamber so that the combustion gases are more completely burned to improve heating efficiency and reduce emissions.

9 Claims, 3 Drawing Figures

WOODBURNING HEATING APPARATUS

BACKGROUND OF THE INVENTION

This invention relates to woodburning heating apparatus and more particularly to such apparatus having high heating efficiency and generating low levels of polluting emissions.

As wood burns in a modern, airtight woodburning stove, products of combustion are created containing polluting emissions including particulate material which is discharged into the atmosphere and compounds such as creosote which can condense onto the inside surface of the chimney. Creosote build-up is dangerous in that it can ignite causing a hazardous chimney fire. Other emissions are damaging to the environment. Furthermore, exhaust gases contain substantial quantities of unburned material whose heating value is thus wasted as they are discharged into the atmosphere.

It is known to pass combustion gases from a woodburning stove through catalytic converters to improve heating efficiency and reduce harmful emissions. The known systems generally dispose the converter within the stove pipe outside the body of the heating apparatus or in the top of the apparatus near the stovepipe connection. Catalytic converters usually consist of a perforate honeycomb structure of ceramic or other material coated with a catalyst material such as platinum, palladium or rhodium. The surface properties of these materials are such that combustion products, too cool to burn on their own, will ignite within the catalytic converting apparatus.

It is also known to retrofit catalytic converting apparatus within conventional woodburning stoves. The potential efficiencies to be gained from catalytic converters, however, have not been achieved in the retrofit stoves because they have not been designed from the beginning to make the best use of catalytic converter apparatus.

It is therefore an object of this invention to provide woodburning heating apparatus which takes full advantage of the catalytic conversion or igniting apparatus.

Another object of the invention is woodburning heating apparatus which is highly efficient in delivering heat into a room to be heated.

Yet another object of this invention is woodburning heating apparatus which substantially reduces the level of harmful emissions into the atmosphere.

A still further object of this invention is woodburning heating apparatus which reduces the build-up of creosote in a chimney.

SUMMARY OF THE INVENTION

The woodburning heating apparatus disclosed herein includes a primary combustion chamber for burning a supply of wood contained therein and a secondary combustion chamber in gaseous communication with the primary combustion chamber. The secondary combustion chamber is lined with a refractory material and includes a perforate catalytic igniter through which combustion gases from the primary combustion chamber flow. The secondary combustion chamber further includes refractory baffles arranged to enhance mixing of the combustion gases and located to re-radiate heat onto the catalytic igniter. Manifolds are provided for introducing secondary combustion air into the secondary combustion chamber so that the combustion gases are more completely burned to improve heating efficiency and reduce harmful emissions. The gases are also directed beyond the secondary baffles in such a manner as to help keep the secondary zone at a more elevated temperature.

In a preferred embodiment, the secondary combustion air is preheated before introduction into the secondary combustion chamber. The preheating is accomplished by placing the secondary combustion air manifolds in heat exchange relation with the combustion gases after they have passed through the catalytic igniter and the subsequent refractory chamber. In this embodiment, the catalytic igniter has a thickness and perforate open area to minimize the pressure drop across the igniter for improved draft of the heating apparatus. To improve the delivery of heat into a room to be heated, the combustion gases pass through side heat exchangers separated from the primary and secondary combustion chambers by convective air space. These side heat exchangers include circuitous passageways to enhance the heat exchange surface area.

BRIEF DESCRIPTION OF THE DRAWING

The invention disclosed herein will be better understood with reference to the drawing of which.

DESCRIPTION OF THE PREFERRED EMBODIMENT

Figure 2:
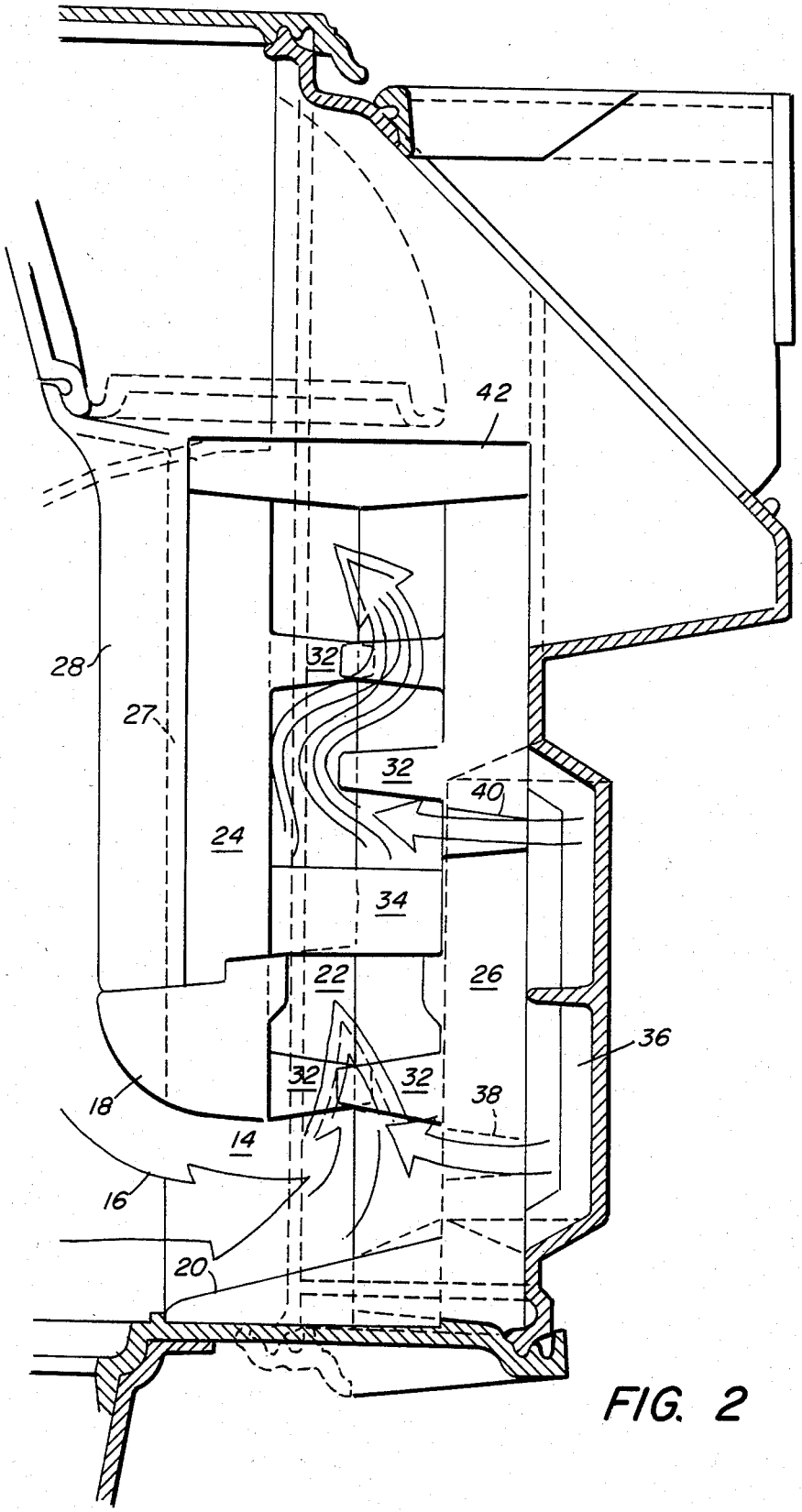
FIG. 2 is a cross-sectional side view taken along section lines 2,2 of FIG. 1.
Figure 3:
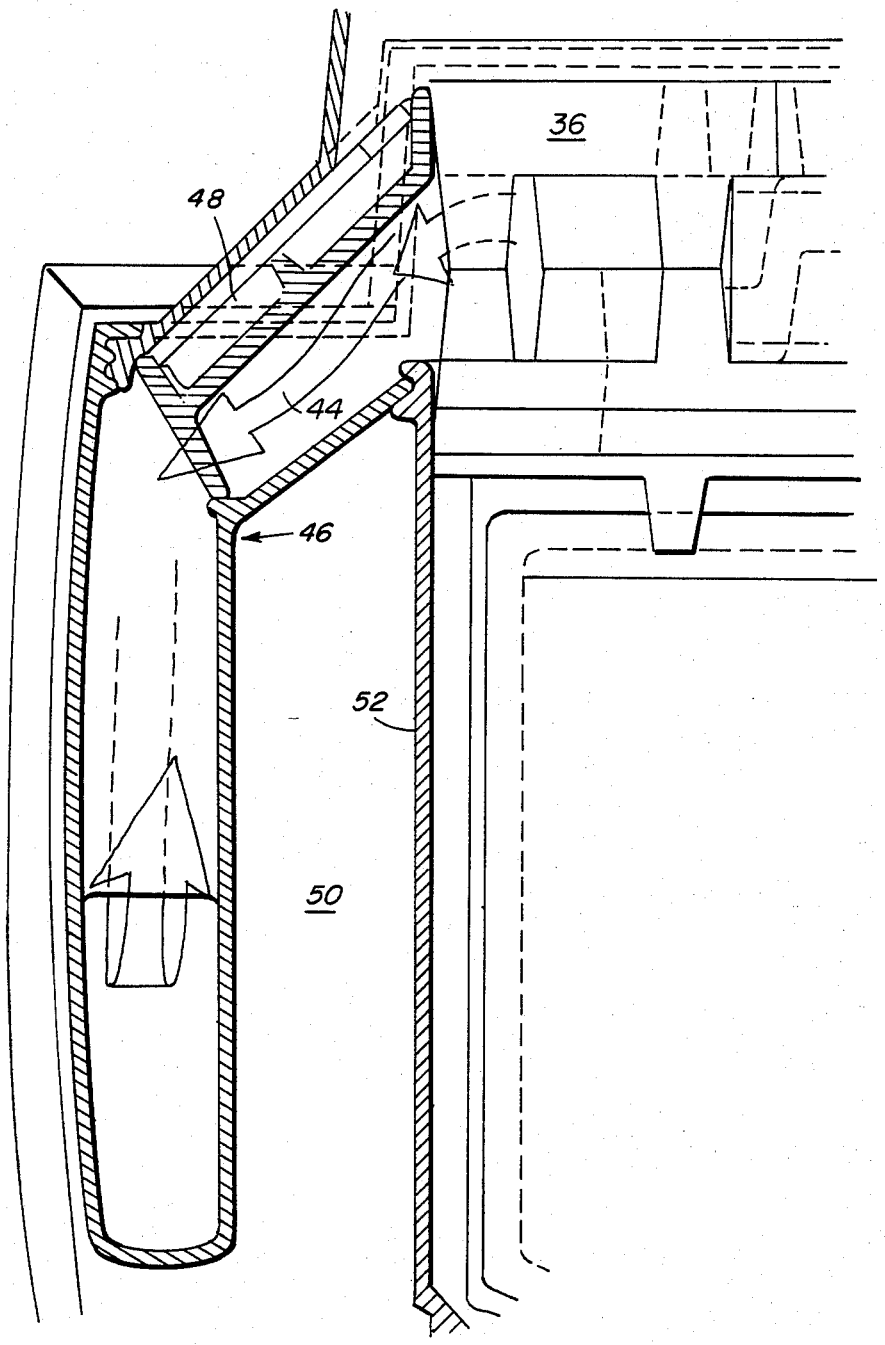
FIG. 3 is a top cross-sectional view along section lines 3,3 of FIG. 1.

The invention disclosed herein will now be described in detail with reference to FIGS. 1, 2 and 3. A woodburning heating apparatus 10 includes a primary combustion chamber 12 suitable for holding wood (not shown) for burning. As wood burns in the primary combustion chamber 12, the combustion gases flow through a passageway 14 in the direction shown by the arrows 16. The passageway 14 is created by an arch 18 and a ramp 20, both made of a refractory material. The incline of the ramp 20 aids in turning the gas flow upwardly and also helps prevent ash build-up thereon. The passageway 14 leads to a secondary combustion chamber 22 created by a front refractory member 24 and a rear refractory member 27. The front refractory member 24 is located adjacent to a metal fireback 27 which faces into the primary combustion chamber 12. The fireback 26 and the refractory arch 18 include ribs 28 which project into the primary combustion chamber 12 to maintain an appropriate air space behind the wood in the primary combustion chamber 12. These ribs 28 are important both for performance of the heating apparatus 10 and to maintain a glass front 30 of the primary combustion chamber 12 in a clean condition.

The front and back refractory members 24 and 26 are preferably vacu-formed/fired low density refractory materials. As can be seen in FIG. 2, the members 24 and 26 include integrally formed baffles 32 which extend into the secondary combustion chamber 22. The members 24 and 26 are also adapted to support a catalytic igniter 34. As shown in FIG. 1, the catalytic igniter 34 is a rectangular honeycombed structure which is made of ceramic or metal and coated with a catalyst material such as platinum, palladium or rhodium. In this embodiment, the catalytic igniter 34 has dimensions of approximately 2½ inches deep, 12 inches long and 1 inch thick. Secondary combustion air from a secondary air manifold 36 enters the secondary combustion chamber 22 through a lower opening 38 and an upper opening 40. The manifold 36 is well insulated to maintain the secondary combustion air in a preheated condition as will be discussed hereinbelow. The top of the secondary combustion chamber 22 is closed by means of a top refractory member 42.

The operation of the heating apparatus 10 will now be discussed still with reference to FIGS. 1, 2 and 3. As wood is burned in the primary combustion chamber 12, combustion gases are forced to flow through the passageway 14 into the secondary combustion chamber 22. The lower baffles 32 create turbulence to enhance mixing of the combustion gases with secondary combustion air entering the secondary combustion chamber 22 through the lower opening 38 in the refractory member 26. The mixture of combustion gases and secondary air proceeds through the perforate catalytic igniter 34. The catalytic igniter 34 has the property of reducing the temperature at which the combustion gases/secondary air combination will ignite to around 500° F. Thus, as the combustion gas/secondary air combination passes through the catalytic igniter 34, combustion takes place releasing heat to maintain a high temperature in the secondary combustion chamber 22. As the products exit the catalytic igniter 34 they are mixed with additional secondary air through the upper secondary air opening 40 in the refractory member 26. The addition of secondary air through the opening 40 in conjunction with the baffles 32 above the igniter 34 result in even further combustion of the gases. It is important to note that the location of the baffles 32, which are made of a refractory material, causes heat to be radiated back onto the catalytic igniter 34 to enhance its operation.

Figure 1:
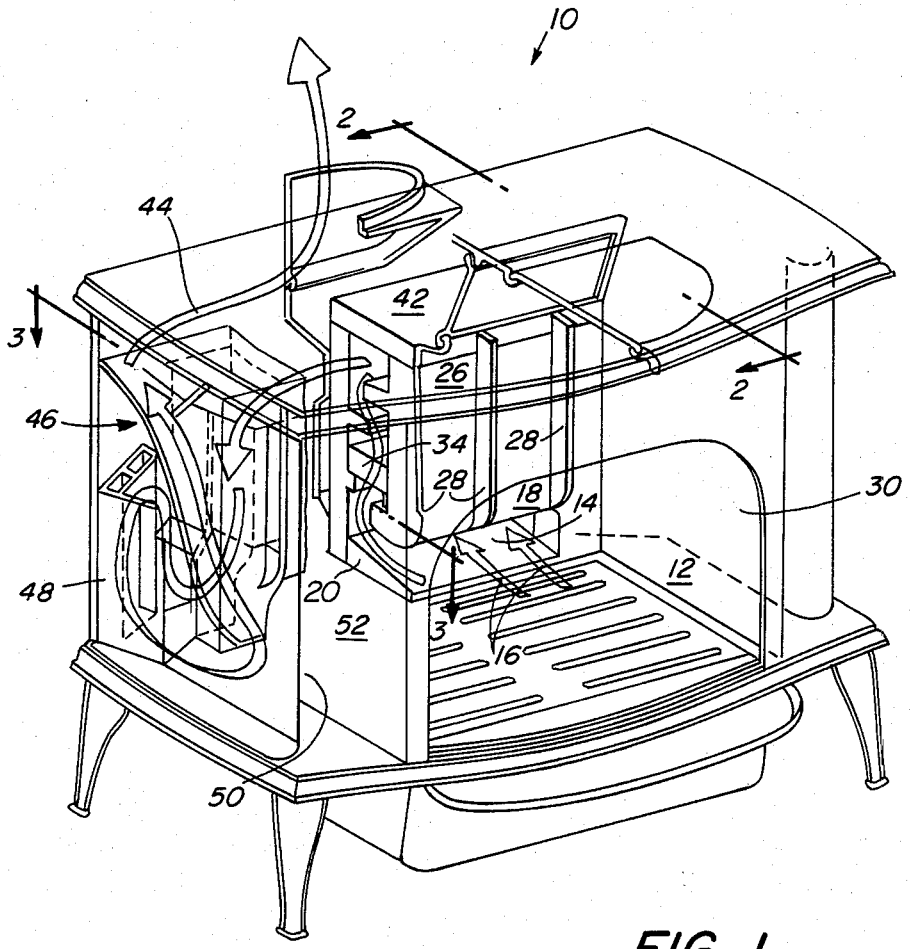
FIG. 1 is a perspective view, partially cut away, of the woodburning heating apparatus disclosed herein.

As can be seen in FIG. 1, the top of the secondary combustion chamber 22 is closed by means of the top refractory member 42 thus forcing the gases from the secondary combustion chamber toward the sides of the heating apparatus 10 and down along the outer surfaces of the secondary combustion chamber. The flow along these surfaces helps maintain a high temperature in the secondary combustion chamber. For the sake of clarity, only one side is shown, but it should be understood that the heating apparatus 10 is symmetrical so that gases will also pass to the right side of the apparatus 10. As shown in FIG. 1, the gases from the secondary combustion chamber 22 are caused to follow a circuitous path shown by the arrow 44 by means of the various metal passageways 46. In particular, the gases traveling along the arrow 44 pass by a secondary air heat exchanger 48. The secondary air heat exchanger 48 is in direct communication with the secondary air manifold 36. Thus, outside air is drawn into the heat exchanger 48 through openings (not shown) where it is preheated by the action of the exhaust gases traveling along the arrow 44 and then enters the manifold 36 for delivery to the secondary combustion chamber 22 through the openings 38 and 40.

As shown in FIG. 1, there is a convective air space 50 which separates the heat exchange passages 46 from the main stove body 52. Thus, heat in the gases passing through the passages 46 not only transfer heat to secondary air entering the secondary air heat exchanger 48, but also cause heat to be transferred to air in the convective air space 50 for subsequent delivery into a room to be heated.

The secondary combustion chamber 22, including the baffles 32 and the catalytic igniter 34, thus causes combustion gases from the primary combustion chamber 12 to be more completely burned generating additional heat which would otherwise be lost both for preheating secondary combustion air before it is delivered into the secondary combustion chamber 22 and for heating air within the convective air space 50 for delivery into a room to be heated. Thus, the efficiency of the woodburning heating apparatus 10 is substantially increased over stoves which do not include a secondary combustion chamber as described hereinabove. Furthermore, because of the additional burning within the secondary combustion chamber 22, the gases which ultimately leave the heating apparatus 10 contain significantly lower amounts of hazardous emissions such as creosote which might otherwise become deposited on the inside surface of a chimney used in conjunction with the heating apparatus 10.

It is thus seen that the objects of this invention have been achieved in that there has been described heating apparatus which generates significantly lower levels of emissions and is more efficient in extracting energy out of the wood fuel. The higher efficiency and lower emissions is the result of a secondary combustion chamber including baffles and a catalytic igniter which causes additional combustion. The baffles are located to reradiate heat energy back into the igniter for still better performance. Heating efficiency is further improved by extracting heat from the exhaust gases, both for preheating the secondary combustion air and for heating air in a convective air space for delivery into the room to be heated. It is recognized that modifications and variations will occur to those skilled in the art and it is intended that all such modifications and variations be included within the scope of the appended claims.

What is claimed is:

1. Woodburning heating apparatus comprising:

a primary combustion chamber for burning a supply of wood contained therein;

a secondary combustion chamber in gaseous communication with said primary combustion chamber;

said secondary combustion chamber being lined with a refractory material and including a perforate catalytic igniter therein through which combustion gases from said primary combustion chamber flow;

said secondary combustion chamber further including refractory baffles arranged to enhance mixing of said combustion gases and located to re-radiate heat onto said catalytic igniter; and means for introducing secondary combustion air into said secondary combustion chamber;

whereby said combustion gases are more completely burned to improve heating efficiency and reduce emissions.

2. The apparatus of claim 1 including means for preheating said secondary combustion air before introduction into said secondary combustion chamber.

3. The apparatus of claim 2 wherein said means for preheating said secondary combustion air comprises secondary combustion air manifolds in heat exchange relation with said combustion gases after said gases have passed through said catalytic igniter and a subsequent refractory-lined chamber.

4. The apparatus of claim 1 wherein said catalytic igniter has a thickness and perforate open are to minimize the pressure drop across said igniter for improved draft.

5. The apparatus of claim 1 wherein said combustion gases pass through side heat exchangers separated from said primary and secondary combustion chambers by convective air spaces for enhanced heat transfer into a room to be heated.

6. The apparatus of claim 5 wherein said side heat exchangers include circuitous passageways to enhance heat exchange surface area.

7. The apparatus of claim 1 wherein the entrance to said secondary combustion chamber includes a lower ramp portion for guiding the combustion gases and for substantially preventing ash build-up in said secondary combustion chamber.

8. The apparatus of claim 1 wherein said catalytic igniter includes a ceramic substrate coated with a catalyst.

9. The apparatus of claim 1 wherein said catalytic igniter includes a metal substrate coated with a catalyst.

* * * * *